US006091009A

United States Patent [19]

Simons et al.

[11] Patent Number: 6,091,009

[45] Date of Patent: Jul. 18, 2000

[54] MUSICAL PERCUSSION INSTRUMENT

[75] Inventors: Richard Simons, Garfield; Donald Kralik, Hewitt, both of N.J.

[73] Assignee: Latin Percussion, Inc., Garfield, N.J.

[21] Appl. No.: 09/237,645

[22] Filed: Jan. 26, 1999

[51] Int. Cl.[7] ..... G10D 13/08

[52] U.S. Cl. ..... 84/402; 84/410

[58] Field of Search ..... 84/402, 403, 409, 84/410, 408; 446/421, 418; 17/22, 99; 248/418, 417, 420, 421, 422

[56] References Cited

U.S. PATENT DOCUMENTS

D. 402,684 12/1998 Wilson et al. ..... D17/99
976,715 11/1910 Bartholomae .
976,718 11/1910 Batholomae ..... 446/441
4,127,053 11/1978 Cohen ..... 84/402
4,779,507 10/1988 Shimoda et al. ..... 84/402
4,867,033 9/1989 Shimoda et al. ..... 84/410
4,898,061 2/1990 Cohen et al. .
5,814,747 9/1998 Ramsell ..... 84/402

*Primary Examiner*—Stanley J. Witowski
*Assistant Examiner*—Kim Lockett
*Attorney, Agent, or Firm*—Ohlandt, Greeley, Ruggiero & Perle, L.L.P.

[57] ABSTRACT

An idiophone musical instrument has at least one agogo bell and a handle or bracket. The bell has an oval, elliptical or rounded shape with a pair of opposed slits, and is formed of plastic. A mounting construction for the bell includes a multisided aperture formed in the bell's body and a mating multisided stem extending from the handle or bracket. The mounting construction prevents twisting even during playing, and permits a choice of different physical orientations of playing positions of the bell.

21 Claims, 3 Drawing Sheets

MUSICAL PERCUSSION INSTRUMENT

BACKGROUND OF INVENTION

1. Field of Invention

This invention relates to musical instruments and, in particular, to percussion instruments of the idiophone type. More particularly, the present invention relates to plastic and synthetic material idiophone type percussion instruments.

2. Description of Prior Art

Idiophone type percussion instruments are generally in the form of a block structure that produces sound when struck by a hard instrumentality such as a drum stick. The block includes a hollow chamber with an opening. When the block is struck, the chamber resonates to produce a musical tone.

A known block type percussion instrument is the Chinese wooden fish, which is a form of a slit drum carved from wood to resemble a mythical fish. The instrument is hollowed out through a ventral slit representing the creature's mouth and struck with a heavy stick. The wooden fish has subsequently been used, in various sizes and configurations in orchestras and has been referred to as a temple block.

Wooden blocks have a number of disadvantages. They are costly to produce. They vary in sound and pitch from one block to another due to variances in density, grain structure and other physical properties of the wood. They splinter and/or crack in the area where the block is usually hit. Wooden blocks have generally been mounted to a bracket or to a handle by a mounting construction that loosens during play of the instrument so as to cause the instrument to twist or rotate away from a desired playing position. Also, the mounting construction limits the instrument to a single physical orientation or playing position.

The disadvantages of wood and of twisting have been overcome with a prior art idiophone formed with plastic by conventional plastic molding processes. For example, U.S. Pat. No. 4,898,061 describes an oblong plastic block having a generally rectangular block portion with an internal chamber. Three sided mounting recesses are formed in an external flange. A mounting bracket contains mounting elements shaped to mate with the landing area recesses so as to avoid twisting. However, the mounting scheme allows only a single playing position for the instrument.

Another block-type percussion instrument, known as a wooden agogo bell, comprises a pair of turned wooden circular chambers mounted on a common support, such as a bracket or a handle. Wooden agogo bells incorporate slots in the chamber walls to alter sound produced by the instrument. Different sizes of wooden agogo bells or blocks are frequently used in a single agogo instrument to produce different tones or pitches of musical sound. U.S. Pat. No. 976,718 describes a toy that employs typical circular chamber type agogo bells.

SUMMARY OF THE INVENTION

It is an object of the present invention to provide an idiophone instrument that is made of plastic or synthetic material.

It is another object of the present invention to provide such an idiophone instrument that is an agogo bell musical instrument that is free of the disadvantages of wooden agogo bell musical instruments, such as variances in sound and pitch due to variations in density, grain and properties of wood.

It is yet another object of the present invention to provide such an agogo bell instrument that has an elegant shape and is capable of maximized sound, volume and tone production.

It is still another object of the present invention to provide such an agogo bell instrument that has a mounting construction that avoids twisting as well as provides a plurality of possible playing positions for the instrument.

It is a further object of the present invention to provide such an agogo bell instrument having a novel and improved handle.

A plastic or synthetic agogo bell musical instrument according to the present invention includes a body that has a generally oval, elliptical or round shaped wall that defines a resonating chamber that is open at a first end of the body. The wall has a first portion with uniform dimensions that extends from the open end to a plane or point toward the other end of the body. A second portion of the wall extends from the plane and tapers toward the other end. The wall has a pair of oppositely positioned slots that extend from the first end toward the plane.

An idiophone instrument according to the present invention comprises a body that has a resonating chamber and an aperture having two or more sides formed in the body to allow a corresponding number of different physical orientations or playing positions of the instrument.

A handle for an idiophone instrument according to the present invention comprises a structure having a loop portion and at least one arm, and preferably two arms, extends from the loop portion. The loop portion has first and second substantially parallel side rails joined by first and second arcuate end rails. Preferably, the axes of the arms and the side rails are coplanar.

BRIEF DESCRIPTION OF THE DRAWINGS

Other and further objects, advantages and features of the present invention will be understood by reference to the following specification in conjunction with the accompanying drawings, in which like reference characters denote like elements of structure.

DESCRIPTION OF THE INVENTION

Figure 1:
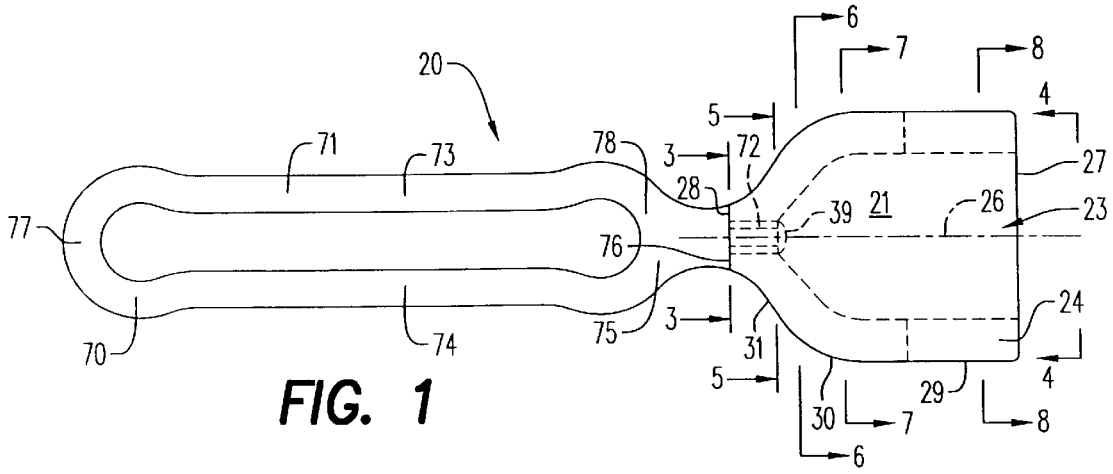
FIG. 1 is a top view of a first embodiment of the musical instrument according to the present invention.

Referring to the drawings and, in particular, to FIG. 1, there is provided a musical instrument according to the present invention, generally represented by numeral 20. The musical instrument 20 is called herein a musical chamber or an agogo bell. In this first embodiment shown in FIGS. 1 through 8, especially FIGS. 1 and 2, agogo bell 20 includes a first agogo chamber 21 and a handle 70.

Figure 8:
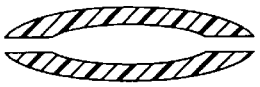
FIG. 8 is a cross sectional view taken along line 8—8 of FIG. 1.

Agogo chamber 21 has a body 23 with a wall 24. Body 23 extends in an axial direction 26 between a first end 27 and a second end 28. Wall 24 has a first portion 29 that extends from first end 27 to a plane or point 30, and a second portion 31 that extends from plane 30 to second end 28. Wall 24 has uniform dimensions throughout first portion 29, and has tapered dimensions in second portion 31. Specifically, wall 24 tapers in second portion 31 from plane 30 toward second end 28. The various cross sections of second portion 31 are shown in FIGS. 5 through 8, while the cross section of first portion 29 is shown in FIG. 8.

Figure 3:
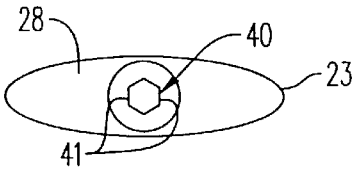
FIG. 3 is a side view taken along line 3—3 of FIG. 1.

As shown in FIG. 3, wall 24 is shaped to define a resonating chamber 25 within body 23. Wall 24 has an outer major axis length L and an outer minor axis width W. Also, wall 24 has an outer surface 34 and an inner surface 35. Outer and inner surfaces 34, 35, respectively, are each generally oval, elliptical or round shaped in cross-section transverse of axial direction 26. Preferably, outer surface 34 has a substantially elliptical shape, and inner surface 35 has a non-elliptical shape.

Elliptical shape of outer surface 34 reduces the amount of material, is aesthetically desired and, more importantly, provides a better striking surface than other shapes.

Figure 2:
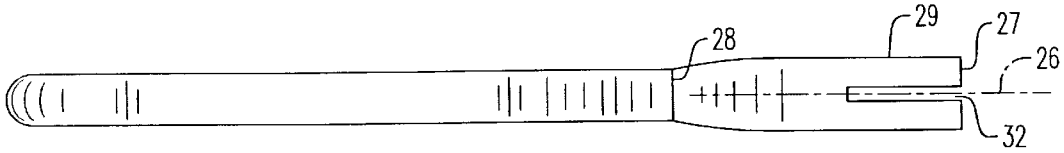
FIG. 2 is a side view of the instrument of FIG. 1.
Figure 5:
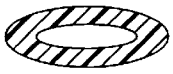
FIG. 5 is a cross sectional view taken along line 5—5 of FIG. 1.
Figure 6:
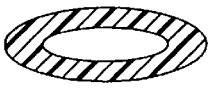
FIG. 6 is a cross sectional view taken along line 6—6 of FIG. 1.
Figure 7:
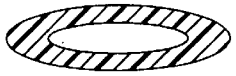
FIG. 7 is a cross sectional view taken along line 7—7 of FIG. 1.

As shown in FIGS. 2 and 3, wall 24 has first slot 32 and second slot 33. First and second slots 32, 33 are situated on opposite sides of body 23 along major axis length L in first portion 29. First and second slots 32, 33 extend in axial direction 26 along first portion 29 from first end 27 towards, but not to second end 28. The depth of each slot 32, 33 in first portion 29 will affect the sound of the agogo chamber 21.

Preferably, dimensions for agogo block 21 are as follows. The thickness of wall 24 is in the range about 4.5 to 9 millimeters. The ratio of major axis length L to minor axis width W for outer surface 34 of first portion 29 is about 3 to 1, to about 1 to 1, preferably 2.2 to 1. The slot width of slots 32 and 33 is about 0.1 to about 0.15 millimeters. Also, the ratio of slot length (depth) to length of agogo chamber 21 is in the range from about 0.25 to about 0.50, to 1 millimeters. For a large agogo chamber, the ratio is about 0.33 to 1 millimeters. For a small agogo chamber, the ratio is about 0.42 to 1 millimeters.

Agogo chamber 21 can be made of plastic, other synthetic material or mixtures thereof. Preferably, agogo chamber 21 is made of plastic. The plastic is preferably one or a combination of hard plastics, such as ABS, fiberglass or acrylic. Agogo chamber 21 is preferably formed as one-piece structures by conventional plastic molding processes, such as injection or blow molding.

The ability to form agogo chamber 21 from plastic avoids the fragile nature of agogo chambers made from wood. In addition, the plastic agogo bells permit slits, that could not be feasible used in a metal agogo bell. The plastic material and slits created a different, and believed more desired, sound. For optimal sound, agogo chamber 21 should be made of plastic, and acoustically coupled to achieve resonate efficiency. This acoustical coupling is preferably achieved by the wall thickness, slot depth and shape of the interior of chamber as set forth in the above embodiments.

Figure 4:
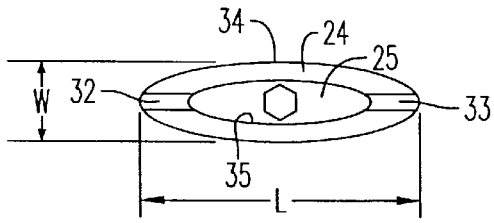
FIG. 4 is a cross sectional view taken along line 4—4 of FIG. 1.

A significant feature of the present invention is the mounting construction feature. As shown in FIG. 4, a multisided aperture 40 is formed in second portion 31 of body 23 at second end 28. Aperture 40 mounts body 23 to handle 70 shown in FIGS. 1 and 2, or a handle shown in FIGS. 9 through 11, or a bracket 37 shown in FIG. 12.

Aperture 40 has at least two side walls or surfaces 41. Preferably, aperture has four to eight side walls or surfaces 41. Most preferably, aperture 40 has six side walls or surfaces 41. When aperture 40 has six side walls 41, it has a hexagonal shape as shown in FIGS. 3 and 4. Aperture 40 may extend entirely through wall 24 or may be formed in outer surface 34 so as to extend partly into wall 24. Preferably, aperture 40 is coaxial with agogo chamber 21.

As shown in FIG. 1, handle 70 has a mounting element or stem 72. Stem 72 can be integral to handle 70 or connected thereto, although the former is preferred. Stem 72 has the same number of sides as aperture 40 so that the stem mates with the aperture.

A screw fastener 39 can be used to secure stem 72 within aperture 40. Alternatively, stem 72 could be secured by glue alone or by screw 39 and glue. The multiple mating sides of aperture 40 and stem 72 prevent twisting or rotation of agogo chamber 21 even if screw 72 or the glue becomes loose. The number of sides of multisided aperture 40 and stem 72 permit that number of different physical orientations or playing positions of agogo chamber 21.

Thus, the mounting construction of mating aperture 40 and stem 72 is advantageously applicable to idiophones or musical instruments 20 of various sizes and shapes. Moreover, the mounting construction provides non-twisting during playing of the instrument 20. Further, the mounting construction permits a number of different playing positions of instrument 20 depending on the number of sides of aperture 40 and mating stem 72.

Handle 70 preferably has an elongated loop portion 71 and an arm 75 extending therefrom. Arm 75 includes a mounting portion 76 that includes multisided stem 72 that mates with aperture 40.

Loop portion 71 is formed of elongated side rails 73 and 74 that are joined at either end by arcuate end rails 77 and 78. Side rails 73 and 74, and arm 75 have central axes that are substantially coplanar and substantially parallel. Side rails 73 and 74 and end rails 77 and 78 may assume any suitable geometrical shape in cross-section and preferably are generally circular.

Figure 9:
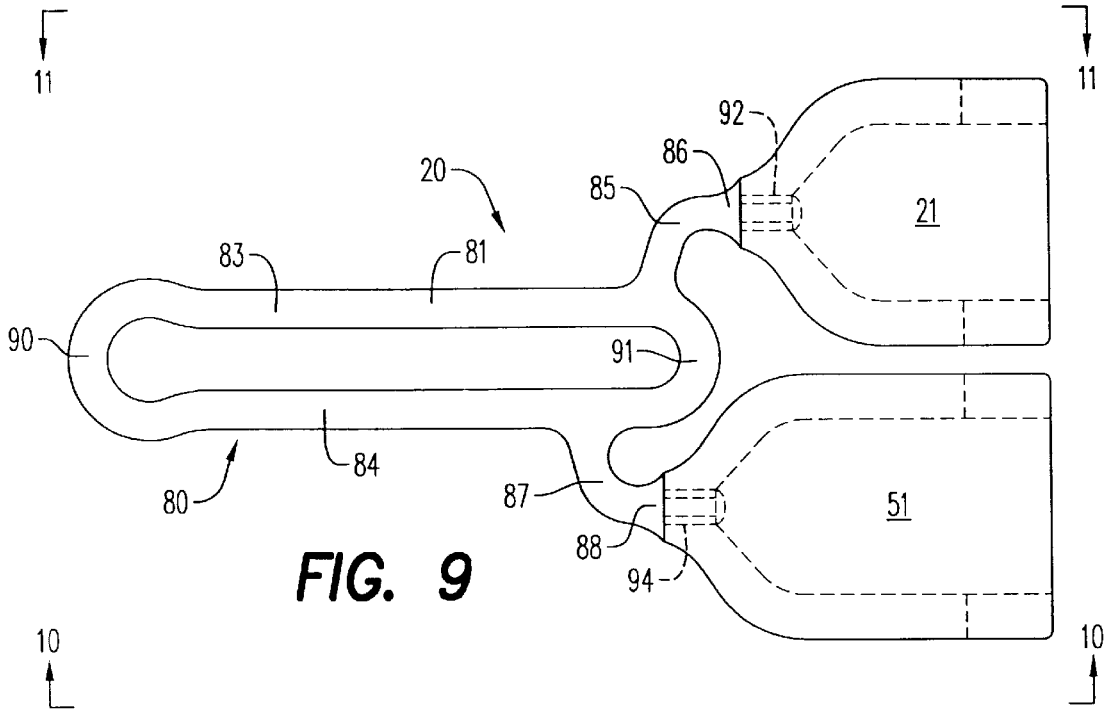
FIG. 9 is a top view of a second embodiment of the musical instrument according to the present invention.
Figure 10:
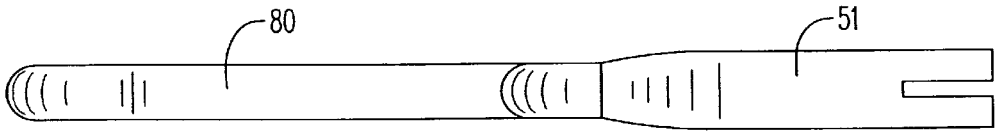
FIG. 10 is a side view taken along line 10—10 of the instrument of FIG. 9.
Figure 11:
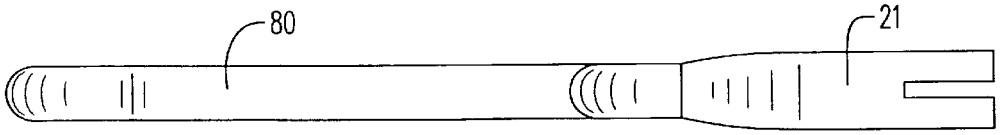
FIG. 11 is a side view taken along line 11—11 of FIG. 9.

FIGS. 9 through 11 is a second embodiment of the present invention. The musical instrument 20 has first agogo chamber 21, a second agogo chamber 51, and a handle 80 connected to the first and second agogo chambers. Agogo chamber 21 is identical to second agogo chamber 51 in all respects except size. As shown, agogo chamber 21 is smaller than second agogo chamber 51. Second agogo chamber 51, like agogo chamber 21, has an elegant elliptical shape and structure that maximizes sound, volume and tone production.

Referring to FIG. 9, handle 80 has connected thereto or integral therewith two multisided stems 92, 94. Stems 92, 94 mate with multisided aperture of agogo chambers 21, 51, respectively.

Handle 80 preferably has an elongated loop portion 81, a first arm 85, and a second arm 87. Arms 85, 87 extend from loop portion 81. Arm 85 includes a mounting portion 86 that includes multisided stem 92, and arm 87 includes a mounting portion 88 that similarly includes multisided stem 94 that mates with agogo chamber 51. Loop portion 81 is formed of elongated side rails 83 and 84 that are joined at either end by arcuate end rails 90 and 91. Side rails 83 and 84, and arms 85 and 87 have central axes that are substantially coplanar and parallel. Side rails 83 and 84 and end rails 90 and 91 may assume any suitable geometrical shape in cross-section and, preferably, are generally circular.

Handles 70 and 80 are preferably one-piece plastic structures. Also preferably, handles 70 and 80 are formed by conventional plastic molding processes, such as injection or blow molding. Preferably, the plastic is one 13 or a combination of hard plastics, such as ABS, fiberglass or acrylic.

Figure 12:
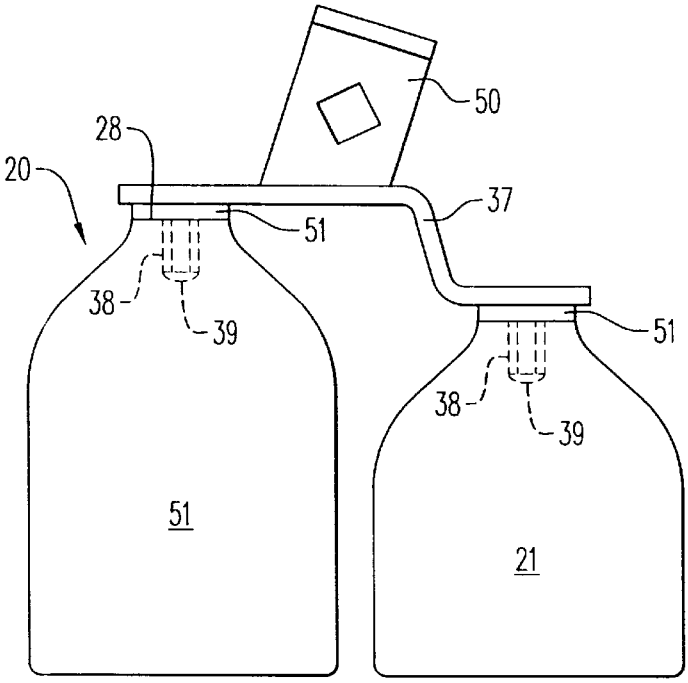
FIG. 12 is an elevational view of a third embodiment of the musical instrument according to the present invention.
Figure 13:
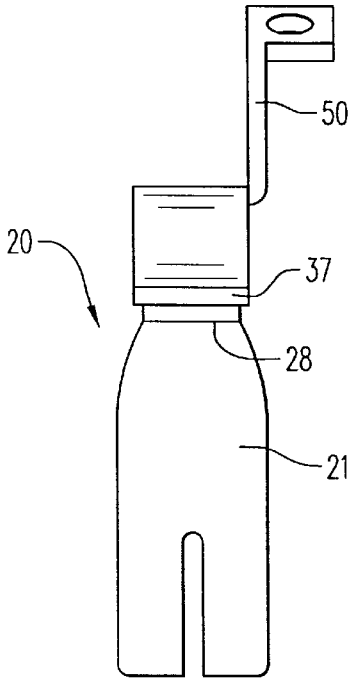
FIG. 13 is a side view of the musical instrument of FIG. 12.

Referring to FIGS. 12 and 13, there is shown a third embodiment of the present invention. The agogo instrument 20 includes agogo chamber 21, second agogo chamber 51, and a bracket 37 that is connected to the two agogo chambers.

The bracket 37 has a pair of multisided stems 38 that mate with the apertures of agogo chamber 21, and second agogo chamber 51 as discussed above.

As with handle 70 and handle 80, bracket 37 can use a screw fastener 39 to secure its stems 38 within apertures 40. Alternatively, stems 38 could be secured by screw 39 and, in addition, perhaps glued. The multiple mating sides of apertures 40 and stems 38 prevents twisting or rotation of agogo chambers 21 and 51. The number of sides of multisided apertures 40 and stems 38 permit that number of different physical orientations or playing positions of agogo chambers 21 and 51. Accordingly, agogo chamber 21 can be positioned in the same plane or a different plane than second agogo chamber 51.

As shown in FIGS. 12 and 13, a mounting element 50 may secure bracket 37 and agogo instrument 20 to a support (not shown). An elastomeric gasket 51 is situated between second end 28 and bracket 37 to absorb vibration when instrument 20 is being played.

The present invention having been thus described with particular reference to the preferred forms thereof, it will be obvious that various changes and modifications may be made therein without departing from the spirit and scope of the present invention as defined in the appended claims.

What is claimed is:

1. A agogo musical instrument made of a material selected from the group consisting essentially of plastic, synthetic materials and mixtures thereof, the instrument comprising:

a body having a wall that defines a resonating chamber within said body, said body extending in an axial direction between a first end and a second end, said chamber being open at said first end, said wall having a cross section transverse to said axial direction, said wall having a first portion that extends from said first end to a plane near said second end and a second portion that extends from said plane to said second end,, said wall having substantially uniform dimensions through out said first portion and tapering in said second portion from said point to said second end, and said wall having first and second slots that extend from said first end along said axial direction.

2. The instrument according to claim 1, wherein said wall has an outer surface and an inner surface.

3. The instrument according to claim 2, wherein said outer surface is a cross section shape selected from the group consisting of oval, elliptical and round.

4. The instrument according to claim 2, wherein said inner surface is a cross section shape selected from the group consisting of oval, elliptical and round.

5. The instrument according to claim 2, wherein said outer wall has an elliptical cross sectional shape.

6. The instrument according to claim 5, wherein said inner surface has a shape selected from the group consisting essentially of oval and round.

7. The instrument according to claim 1, further comprising a handle secured to said second end.

8. The instrument according to claim 7, wherein said handle has a mounting element, and wherein said mounting element has at least two side surfaces.

9. The instrument according to claim 8, wherein said second end has an aperture with at least two side surfaces that mate with the at least two side surfaces of said mounting element so that said body does not twist on said handle.

10. The instrument according to claim 9, wherein the at least two side surfaces of said aperture is six sides, and wherein the at least two side surfaces of said mounting element is six sides.

11. The instrument according to claim 1, wherein said second end has an aperture with at least two side surfaces.

12. The instrument according to claim 11, further comprising a handle secured to said second end, wherein said handle an elongated loop portion and at least one arm extending from said loop portion, and wherein said at least one arm has a mounting element with at least two side surfaces that mate with the at least two side surfaces of said aperture so that said body does not twist on said handle.

13. A agogo musical instrument made of a material selected from the group consisting essentially of plastic, synthetic materials and mixtures thereof, the instrument comprising:

a pair of bodies, each body having a wall that defines a resonating chamber within said body, said body extending in an axial direction between a first end and a second end, said chamber being open at said first end, said wall having a cross section transverse to said axial direction, said wall having a first portion that extends from said first end to a plane near said second end and a second portion that extends from said plane to said second end, said wall having substantially uniform dimensions through out said first portion and tapering in said second portion from said point to said second end, and said wall having first and second slots that extend from said first end along said axial direction; and a handle having an elongated loop portion and first and second arms extending therefrom, said first and second arms having said first and second mounting elements, respectively, wherein said first and second mounting elements secure said a different one of said pair of bodies to said handle.

14. The instrument according to claim 13, wherein said first and second mounting element each has at least two side surfaces that mate with the at least two side surfaces of said respective aperture so that said body does not twist on said handle.

15. The instrument according to claim 14, wherein said first and second mounting means in conjunction with said respective aperture secures said pair of bodies in any desired playing position.

16. An idiophone instrument comprising:

a least one body having a resonating chamber formed within said body, said body having an end with an aperture therein, said body made of a material selected from the group consisting essentially of plastic, synthetic material and mixtures thereof, said aperture having at least two side surfaces; and a handle having a loop portion and at least one arm extending from said loop portion and being secured to said body, said arm having a stem with at least two side surfaces that mate with said at least two side surfaces of said body so that said body does not twist about said handle, and said body can be positioned in a plane as desired about said stem.

17. The instrument according to claim 16, wherein the at least one body has an elliptical cross sectional shape.

18. The instrument according to claim 16, wherein said handle has a second arm extending from said loop portion for mounting a second body substantially identical, except for size, to said body.

19. A mounting construction for the bell having a body, the construction includes a multisided aperture formed in the body of the bell, and a mating multisided stem extending from a handle, wherein said aperture and stem allow at least two different physical orientations of the body of the bell.

20. The construction according to claim 19, wherein the multisided aperture has six sides.

21. The construction according to claim 19, wherein the multisided aperture has two or more sides.

* * * * *